US006227933B1

(12) United States Patent
Michaud et al.

(10) Patent No.: US 6,227,933 B1
(45) Date of Patent: May 8, 2001

(54) ROBOT BALL

(75) Inventors: François Michaud, Rock Forest; Serge Caron, Sherbrooke, both of (CA)

(73) Assignee: Universite de Sherbrooke, Sherbrooke ( * ) Notice: Subject to any disclaimer, the term of this patent is extended or adjusted under 35 U.S.C. 154(b) by 0 days.

(21) Appl. No.: 09/594,094

(22) Filed: Jun. 15, 2000

(30) Foreign Application Priority Data

Jun. 15, 1999 (CA) ..... 2274770

(51) Int. Cl.[7] ..... A63H 29/02

(52) U.S. Cl. ..... 446/462; 446/458

(58) Field of Search ..... 446/443, 458

(56) References Cited

U.S. PATENT DOCUMENTS

| | | | | |
|---|---|---|---|---|
| 2,939,246 | * | 6/1960 | Glos | 446/462 |
| 2,949,696 | * | 8/1960 | Easterling | 446/462 |
| 3,722,134 | * | 3/1973 | Merrill et al. | 446/462 |
| 3,798,835 | | 3/1974 | McKeehan | 46/243 |
| 4,726,800 | * | 2/1988 | Kobayashi | 446/458 |
| 4,927,401 | | 5/1990 | Sonesson | 446/456 |
| 5,297,981 | | 3/1994 | Maxim et al. | 446/437 |
| 5,439,408 | | 8/1995 | Wilkinson | 446/409 |
| 5,533,920 | | 7/1996 | Arad et al. | 446/409 |
| 5,533,921 | | 7/1996 | Wilkinson | 446/409 |
| 5,692,946 | | 12/1997 | Ku | 446/456 |
| 5,823,845 | | 10/1998 | O'Berrigan | 446/234 |
| 5,947,793 | | 9/1999 | Yamakawa | 446/431 |

FOREIGN PATENT DOCUMENTS 2091218 3/1993 (CA) .

* cited by examiner

*Primary Examiner*—Jacob K. Ackun, Jr.
*Assistant Examiner*—Faye Francis
(74) *Attorney, Agent, or Firm*—Goudreau Gage Dubuc

(57) ABSTRACT

The robot ball comprises an encapsulating shell, a drive system and a steering system. The shell has an axis of rotation and an outer annular tread surface centered on the axis of rotation. The drive system is encapsulated in the shell and comprises a first motorized mechanism and a counterweight. The first motorized mechanism has a stator portion and a rotor portion centered on the axis of rotation and connected to the shell. The counterweight is connected to the stator portion and is spaced apart from the axis of rotation whereby, due to inertia of the counterweight, rotation of this rotor portion rotates the shell to roll the tread surface on the ground. The steering system comprises a second motorized mechanism through which the counterweight is connected to the stator portion. This second motorized mechanism includes a pivot assembly having a pivot axis transversal to the axis of rotation. Therefore, activation of the second motorized mechanism rotates the counterweight about the pivot axis, tilts the axis of rotation, displaces the center of gravity of the robot ball, and thereby changes the trajectory of the robot ball. An inclinometer is mounted on the stator portion to measure an inclination of the stator portion about the axis of rotation, and a controller regulates the speed of rotation of the rotor portion in relation to the measured inclination. The robot ball further includes a second inclinometer so mounted on the platform as to measure an inclination about the pivot axis. The controller then controls the electric servomotor in relation to the measured platform inclination about the pivot axis.

23 Claims, 11 Drawing Sheets

ROBOT BALL

BACKGROUND OF THE INVENTION

1. Field of the Invention

The present invention relates to an autonomous robot ball capable of displacing in various environments, including indoors as well as outdoors.

2. Brief Description of the Prior Art

Upon designing a robot, the main difficulty is to make it sufficiently robust to sustain all environmental and operating conditions: shocks, stairs, carpets, various obstacles, manipulations by the children in the case of a toy, etc.

Prior art wheeled robot can turn upside down and, then, be incapable of relieving this deadlock.

A prior art solution to this problem is to use wheels bigger than the body of the robot. However, this does not prevent the robot from blocking in elevated position onto an object.

Another solution to this problem is described in the following prior art patents:

U.S. 3,798,835 (McKeehan) Mar. 26, 1974

U.S. 5,533,920 (Arad et al.) Jul. 9, 1996

U.S. 5,947,793 (Yamakawa) Sep. 7, 1999

CA 2 091 218 (Christen) Jul. 5, 1994

This solution consists of building a robot around a spherical shell enclosing a drive system. This drive system comprises an electric drive motor for rotating the spherical shell about an axis of rotation and thereby propelling the robot. The counter-rotating force on the electric drive motor is produced by a counterweight spaced apart from the axis of rotation. A drawback of such prior art robot balls is that steering thereof is not provided for.

OBJECTS OF THE INVENTION

An object of the present invention is therefore to provide a robot ball having steering capabilities.

Another object of the present invention is to provide a robot ball comprising an inclinometer to control the speed of rotation of the electric drive motor in relation to the angular position of the counterweight about the axis of rotation.

SUMMARY OF THE INVENTION

More specifically, in accordance with the present invention, there is provided a robot ball comprising an encapsulating shell, a drive system encapsulated in the shell and comprising a first motorized mechanism and a counterweight, and a steering system comprising a second motorized, counterweight displacing mechanism. The encapsulating shell has an axis of rotation and an outer annular tread surface centered on this axis of rotation. The first motorized mechanism has a stator portion and a rotor portion centered on the axis of rotation and connected to the shell. The counterweight is connected to the stator portion and spaced apart from the axis of rotation whereby, due to inertia of the counterweight, rotation of the rotor portion rotates the shell to roll the tread surface on the ground. The second motorized mechanism connects the counterweight to the stator portion, and defines a course of displacement of the counterweight which extends along the axis of rotation.

In operation, activation of the second motorized mechanism displaces the counterweight along the axis of rotation, tilts this axis of rotation, displaces the center of gravity of the robot ball, and thereby changes the trajectory of the robot ball. This provides for steering of the robot ball.

According to a preferred embodiment, the second motorized mechanism includes a pivot assembly having a pivot axis transversal to the axis of rotation whereby, in operation, activation of the second motorized mechanism rotates the counterweight about the pivot axis, tilts the axis of rotation, displaces the center of gravity of the robot ball, and thereby changes the trajectory of the robot ball.

In accordance with other preferred embodiments of the robot ball:

- the encapsulating shell comprises a generally spherical outer face;
- the annular tread surface is generally elliptical in a cross sectional plane in which the axis of rotation is lying;
- the pivot axis is substantially perpendicular to the axis of rotation;
- the stator portion comprises a platform;
- the first motorized mechanism comprises at least one electric drive motor having a stator and a rotor, the stator of the electric motor is secured to the platform, the rotor of the electric motor is centered on the axis of rotation and is connected the shell;
- the first motorized mechanism comprises first and second electric drive motors each having a stator and a rotor, the stator of the first electric drive motor is secured to the platform, the stator of the second electric drive motor is secured to the platform, the rotor of the first electric drive motor is centered on the axis of rotation and is connected a first point of the shell, and the rotor of the second electric drive motor is centered on the axis of rotation and is connected to a second point of the shell diametrically opposite to the first point of this shell;
- the platform comprises an underside, the second motorized mechanism comprises an electric servomotor having a stator and a rotor, the stator of the electric servomotor is secured to the underside of the platform, and the rotor of the electric servomotor is centered on the pivot axis and is connected to the counterweight;
- the counterweight comprises an electric battery;
- the counterweight comprises an electric battery and a bracket to mechanically connect the battery to the rotor of the servomotor;
- the robot ball further comprises an inclinometer so mounted on the platform as to measure an inclination of this platform about the pivot axis, and a controller of the electric servomotor in relation to the measured platform inclination about the pivot axis; and
- the robot ball further comprises at least one external sensors and a robot ball controller responsive to these sensors, these external sensors comprise a robot ball spin sensor unit detecting spinning of the robot ball, a voice instructions recognising system, and/or a tactile system, and the robot ball further comprises a voice message generating system controlled by the robot ball controller;
- the robot ball further comprises an obstacle detector and a controller of the second motorized mechanism in response to an obstacle detected by the obstacle detector.

Also in accordance with the present invention, there is provided a robot ball comprising an encapsulating shell, a drive system encapsulated in the shell and comprising a motorized mechanism and a counterweight, an inclinometer and a controller. The encapsulating shell has an axis of rotation and an outer annular tread surface centered on the axis of rotation. The motorized mechanism has a stator portion and a rotor portion centered on the axis of rotation and connected to the shell. The counterweight is connected to the stator portion and spaced apart from the axis of rotation whereby, due to inertia of the counterweight, rotation of the rotor portion rotates the shell to roll the tread surface on the ground. The inclinometer is so mounted on the stator portion as to measure an inclination of this stator portion about the axis of rotation, and the controller regulates the speed of rotation of the rotor portion in relation to the measured inclination.

In this manner, the inclinometer allows the robot ball to control the angular position of the motorized mechanism about the axis of rotation.

Preferably, the stator portion comprises a platform and the inclinometer is mounted on the platform.

According to a preferred embodiment, the motorized mechanism comprises at least one electric drive motor having a stator and a rotor, the stator of the electric drive motor is secured to the platform, the rotor of the electric drive motor is centered on the axis of rotation and is connected the shell, the inclinometer is mounted on the platform to measure an inclination of this platform about the axis of rotation, and the controller is a controller of the speed of rotation of the electric drive motor in relation to the measured platform inclination.

Other objects, advantages and features of the present invention will become more apparent upon reading of the following non-restrictive description of a preferred embodiment thereof, given by way of example only with reference to the accompanying drawings.

DETAILED DESCRIPTION OF THE PREFERRED EMBODIMENT

A preferred embodiment of the robot ball according to the present invention will now be described. In the appended drawings, the robot ball is generally identified by the reference 1. Also, identical elements are identified by the same references in the different figures of the drawings.

Encapsulating Shell 2

Figure 1:
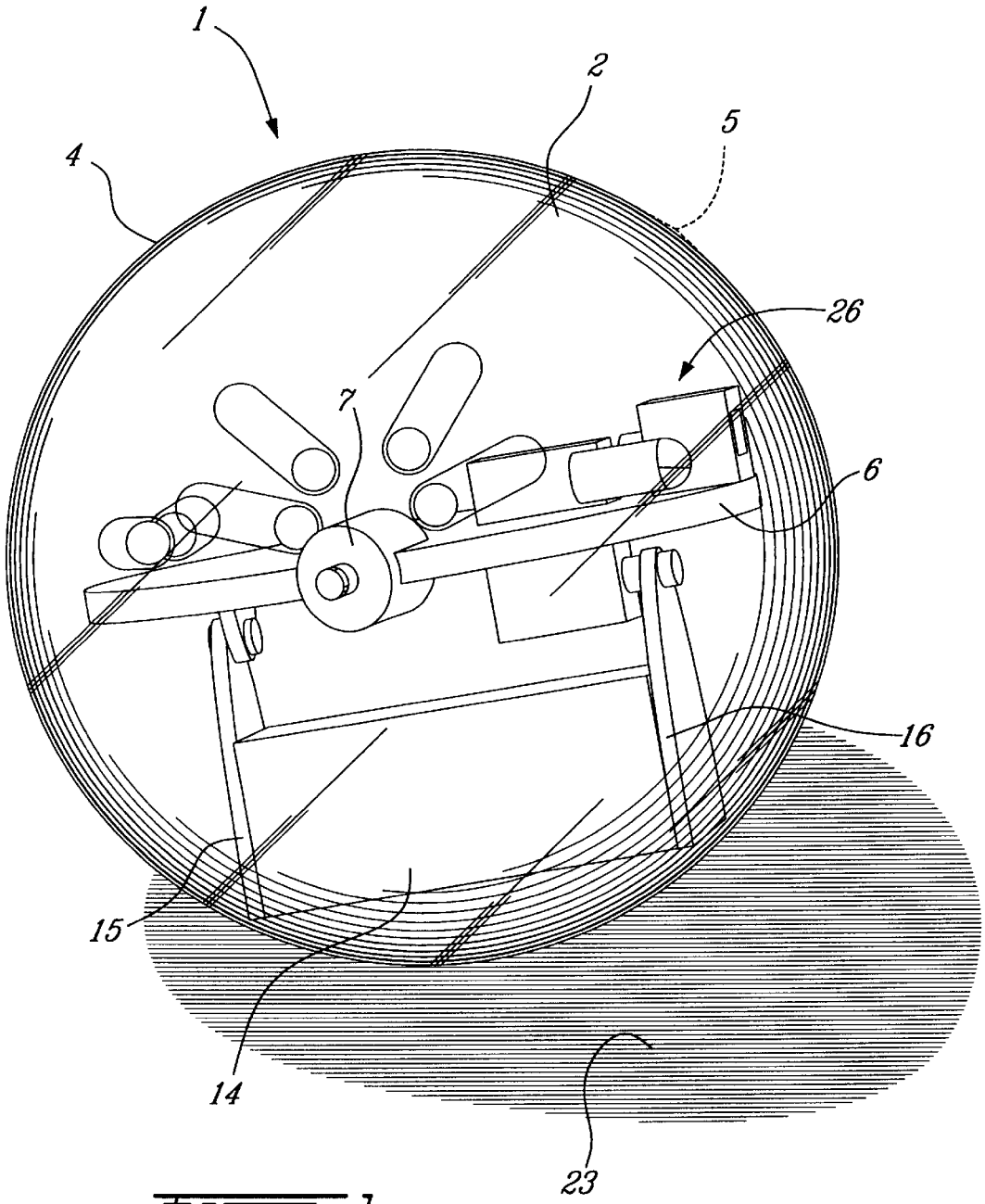
FIG. 1 is a side, perspective view of the preferred embodiment of the robot ball according to the present invention.
Figure 2:
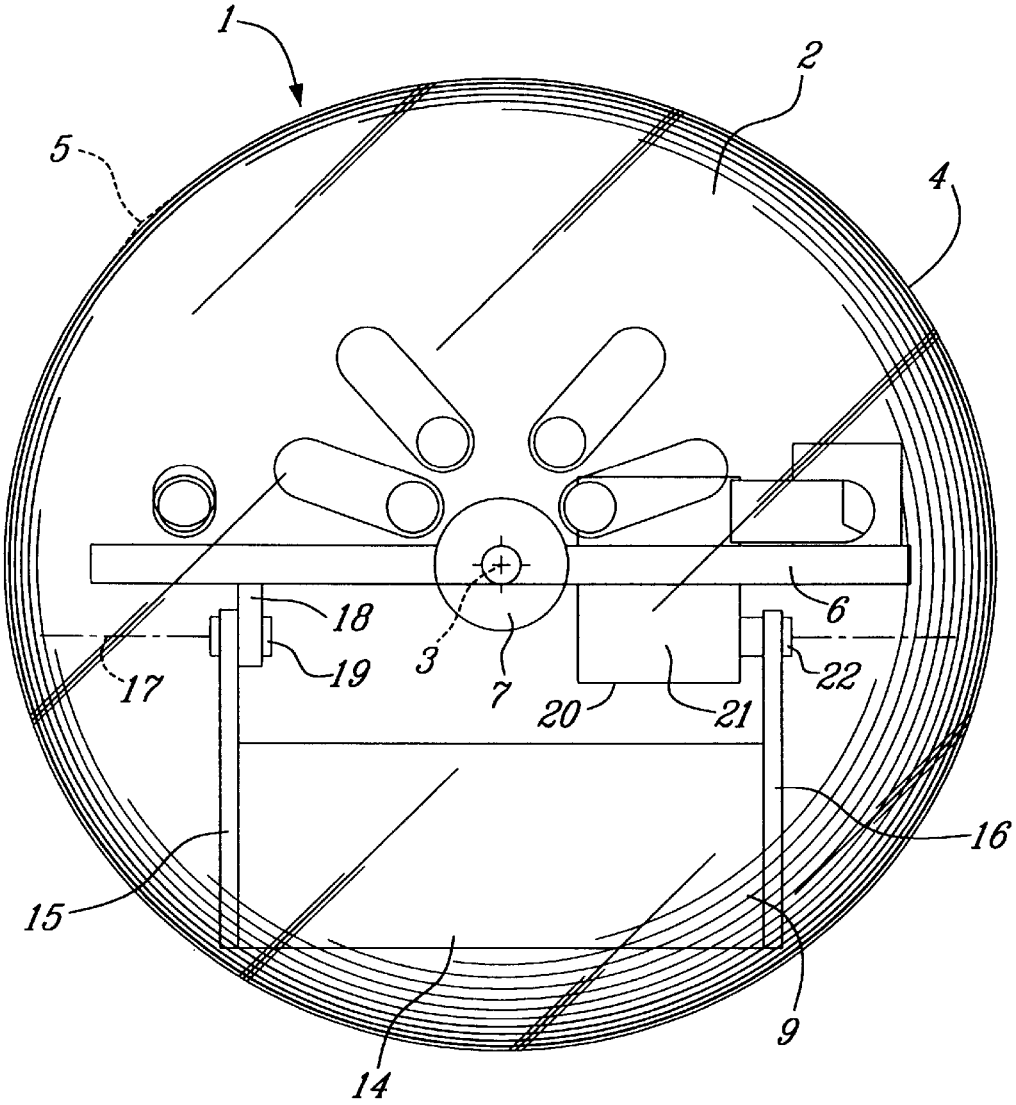
FIG. 2 is a side elevational view of the robot ball of FIG. 1.
Figure 3:
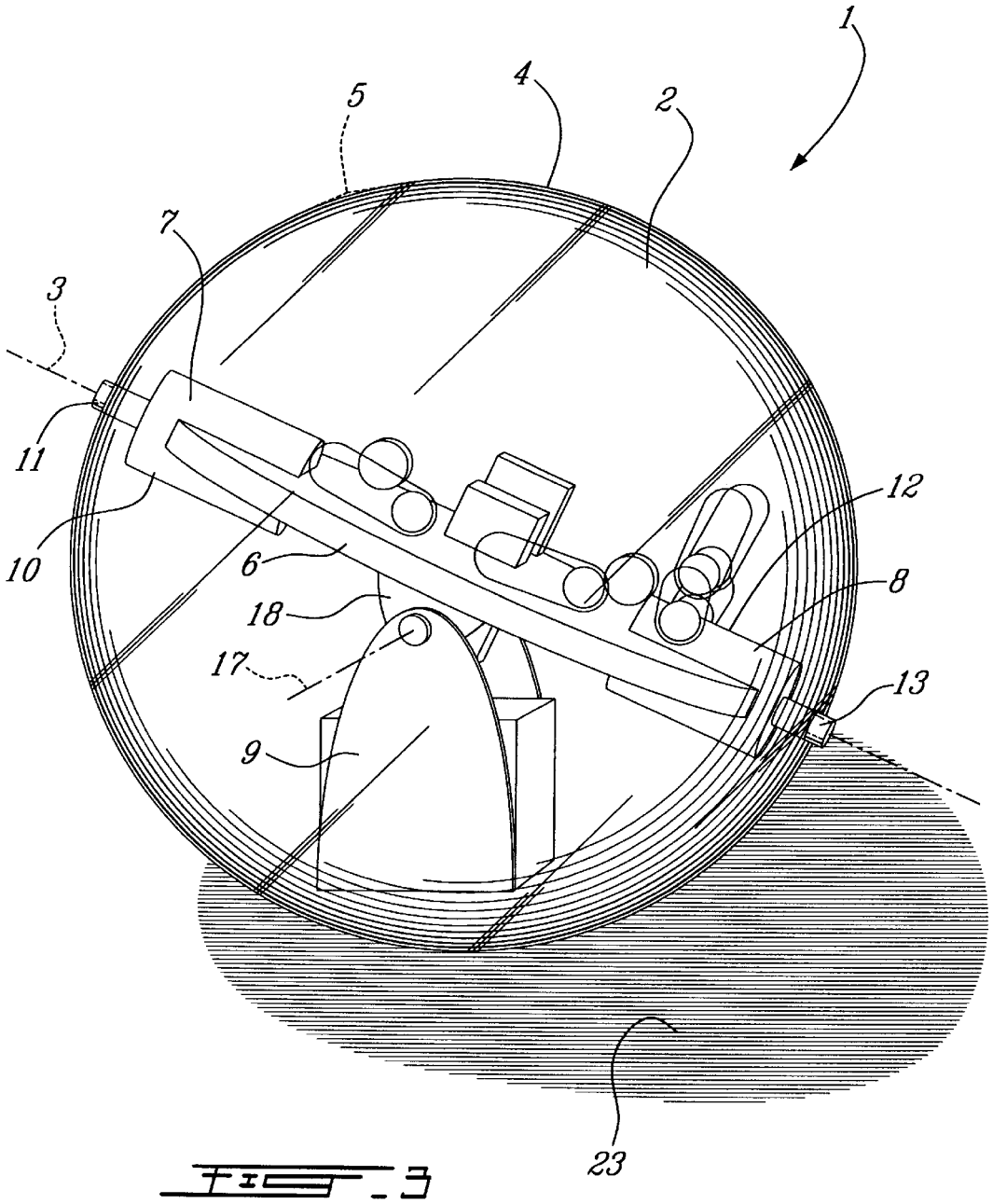
FIG. 3 is a rear, perspective view of the robot ball of FIG. 1.

As illustrated in FIGS. 1–3, the robot ball 1 is encapsulated in a shell 2. As will be seen in the following description, the shell 2 is rotated about an axis of rotation 3 to propel the robot ball 1. For that purpose, the shell 2 will be preferably spherical to provide for a uniform tread 4 semicircular in the cross section defined by a plane in which the axis of rotation 3 is lying.

In the present specification and the appended claims, the term "ground" is intended to designate interior ground surfaces as well as exterior ground surfaces. This will include the floor of a house, concrete floors, lawn, pavement, etc.

However, this is within the scope of the present invention to provide a shell 2 which is oval-shaped in the same cross section, defined by a plane in which the axis of rotation 3 is lying. In such a case, the tread 4 will be broadly elliptical in cross section. This is even within the scope of the present invention to provide a shell 2 having a tread 4 broadly elliptical in cross section in the above defined plane in which the axis 3 is lying, with two parallel, flat opposite sides.

Generally speaking, the shell 2 will present a shape susceptible to facilitate displacement of the robot ball 1. To that effect, the shell 2 will be spherical or oval-shaped as described above. The shell 2 can also be hexagonal, spherical with cylindrical extensions centered on the axis of rotation 3, etc. The shell 2 may further comprise paddles to displace the robot ball 1 on a surface of water.

Also, the surface of the tread 4 can be formed with corrugations such as 5 to better grip the surface of the ground.

Of course, the shell 2 can be reinforced as required for example by means of inner ribs. The shell 2 can further be made of transparent plastic material to enable any detection, for example to enable machine vision and obstacle detection, from inside the shell 2.

Finally, the shell 2 can be made of two hemispheric parts or more than two parts which can be dismantled to enable opening of the shell 2 and therefore maintenance or repair of the robot ball 1. An alternative is to provide the shell 2 with an access door.

Drive System

The robot ball 1 also comprises a drive system to roll the tread 4 of the shell 2 on the ground and therefore propel the robot ball 1. The drive system generally comprises a platform 6, a pair of reversible electric drive motors 7 and 8, and a counterweight 9.

Platform 6

As it will be described hereinafter, the platform 6 supports most of the internal components of the robot ball 1, including the counterweight 9. As illustrated in FIG. 1, the platform 6 is generally flat. Also, since the illustrated shell 2 is generally spherical, the platform 6 is shown generally circular, although a generally hexagonal or other suitable shapes can be contemplated. In the case of an oval-shaped shell 2, the platform 6 could present a corresponding oval shape.

Drive Motors 7 and 8

Referring to FIG. 3, electric drive motor 7 comprises a housing 10 (stator) fixedly secured to the platform 6. Electric drive motor 7 also comprises a rotative shaft 11 (rotor) connected to a first point of the shell 2 along the axis of rotation 3. Just a word to mention that the shaft 11 is connected to the shell 2 to rotate said shell 2 therewith about axis 3. For that purpose, the shaft 11 is centered on the axis of rotation 3 as illustrated in FIG. 3.

In the same manner, electric drive motor 8 comprises a housing 12 (stator) fixedly secured to the platform 6. Electric drive motor 8 also comprises a rotative shaft 13 (rotor) connected to a second point of the shell 2 diametrically opposite to the above mentioned first point. Just a word to indicate that the shaft 13 is connected to the shell 2 to rotate said shell 2 therewith about axis 3. For that purpose, the shaft 13 is centered on the axis of rotation 3 as illustrated in FIG. 3.

Accordingly, rotation of the shafts 11 and 13 of the electric drive motors 7 and 8 in one angular direction will rotate the shell 2 therewith in the same direction about the axis of rotation 3. While rotation of the shafts 11 and 13 will tend to rotate the platform 6 about the axis of rotation 3, the inertia of the counterweight 9 will provide the necessary counter-rotating force on the drive motors 7 and 8 to maintain the platform 6 in a substantially horizontal position as shown in FIG. 2. Those of ordinary skill in the art will appreciate that rotation of the shafts 11 and 13, in combination with the inertia of the counterweight 9 will cause rolling of the tread 4 on the ground to propel the robot ball 1.

In the absence of obstacles along the trajectory of the robot ball 1, speed regulation of the electric motors 7 and 8 will keep the platform 6 substantially horizontal over the duration of the displacement.

Since the electric drive motors 7 and 8 are reversible, the direction of movement of the robot ball 1 can be reversed by reversing the direction of rotation of these electric drive motors 7 and 8.

Also, just a word to mention that the two drive motors 7 and 8 could be replaced by a single motor, if desired.

It should also be mentioned that the drive motors 7 and 8 can be equipped with single encoders or, alternatively, encoders in quadrature to enable a better regulation of the speed of rotation of the drive motors 7 and 8 and therefore the speed and trajectory of the robot ball 1.

Counterweight 9

The counterweight 9 comprises a battery 14 presenting, in the illustrated example, the general configuration of an elongated parallelepiped. The battery 14 is supported from the underside of the platform 6 by a pair of end brackets 15 and 16.

The battery 14 is preferably a rechargeable battery; charge connectors (not shown) for charging the battery 14 can be provided on the outer face of the shell 2 in the proximity of the axis 3 of this shell 2.

As described hereinabove, the shell 2 can be opened for maintenance and repair purposes. Therefore, if non rechargeable batteries are used, the shell 2 can be opened when required to change the batteries.

Referring to FIGS. 2 and 3, the counterweight 9 can be pivoted about a pivot axis 17 perpendicular to the axis 3 but parallel to the plane of the platform 6.

For that purpose, a bracket 18 is secured to the underside of the platform 6 and the upper portion of the bracket 15 is connected to the underside bracket 18 through a pivot 19 centered on the pivot axis 17.

For the same purpose, the upper portion of the bracket 16 is connected to the underside of the platform 6 through a reversible electric servomotor 20. Servomotor 20 comprises a housing 21 (stator) fixedly secured to the underside of the platform 6. Servomotor 20 also comprises a rotative shaft 22 (rotor) centered on the pivot axis 17. Just a word to mention that the rotative shaft 22 is connected to the upper portion of the bracket 16 in such a manner that the bracket 16 will be set into rotation about the pivot axis 17 by rotation of the shaft 22.

In operation, activation of the servomotor 20 will rotate the counterweight 9 about the axis 17 to displace this counterweight along the axis of rotation 8 and change the center of gravity of the robot ball 1. Due to the force of gravity and the inertia of the counterweight 9, this will cause tilting of the platform 6 and axis of rotation 3 about the pivot axis 17 (see FIG. 3) by providing the necessary counter-rotating force on the drive motors 7 and 8. Those of ordinary skill in the art will appreciate that, in the position of FIG. 3, rotation of the shafts 11 and 13 of the electric drive motors 7 and 8 will still roll the shell 2 on the ground 23. However, since the circular portion of the tread 4 contacting the ground is still centered on the axis of rotation 3 but is offset laterally from the central plane of symmetry of the shell 2 perpendicular to this axis 3, the trajectory of the robot ball 1 will then be semicircular. Therefore, appropriate operation of the servomotor 20 to rotate the shaft 22 and counterweight 9 in either direction will control the direction of movement of the robot ball on the ground 23. This will enable steering of the robot ball 1.

Just a word to mention that it is within the scope of the present invention to implement other structures of counterweight.

Of course, the battery 14 constitutes the source of energy of the robot ball 1, in particular but not exclusively to supply the motors 7, 8 and 20. However, just a word to point out that use of motors other than electric motors can be contemplated.

Inclinometers

The robot ball further comprises a pair of inclinometers to detect angular positions of the platform 6 with respect to the horizontal, and more specifically about axes 3 and 17, respectively.

Figure 4:
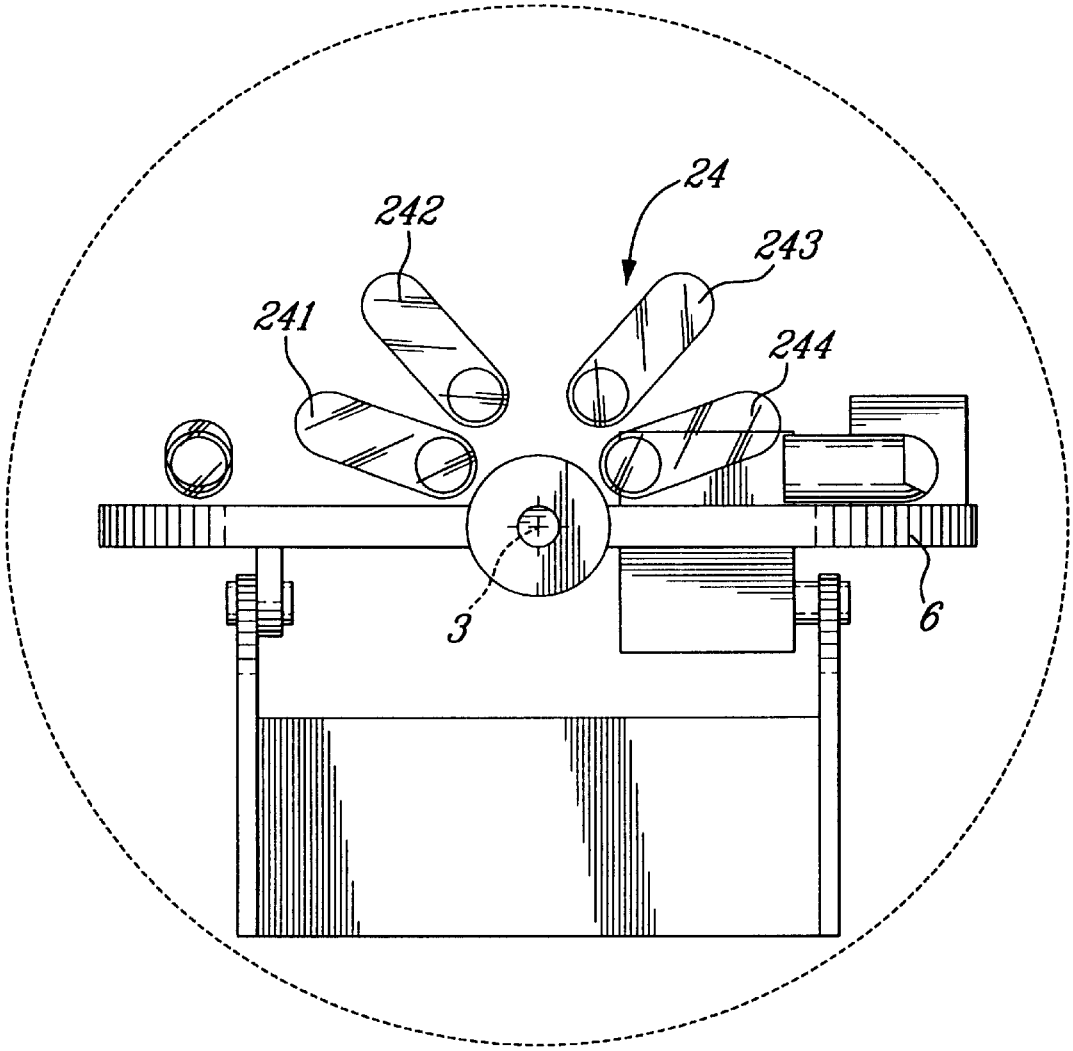
FIG. 4 is a side, elevational view of the drive and steering systems of the robot ball of FIG. 1.
Figure 5:
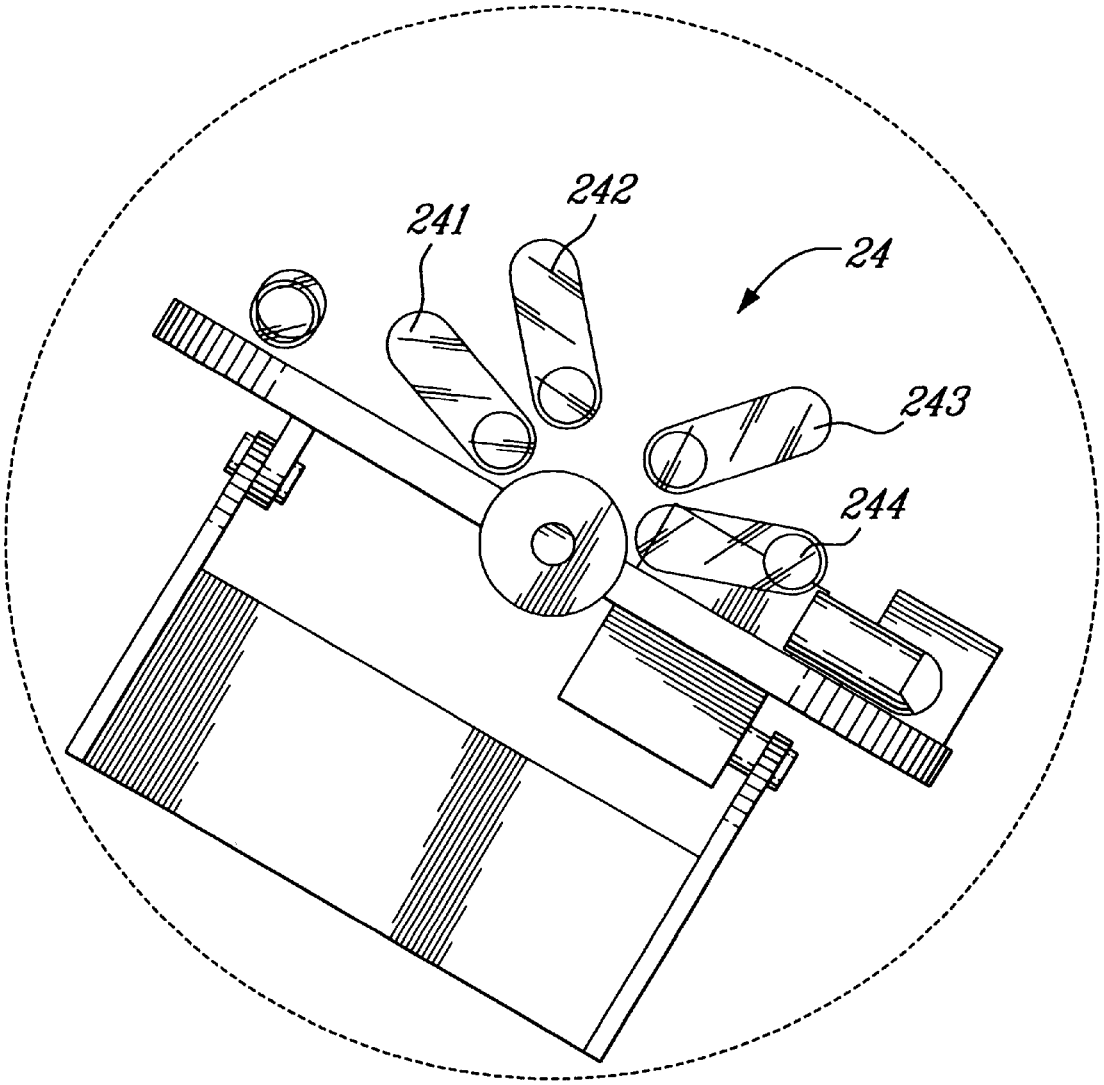
FIG. 5 is a side, elevational view of the drive and steering systems of the robot ball of FIG. 1.
Figure 6:
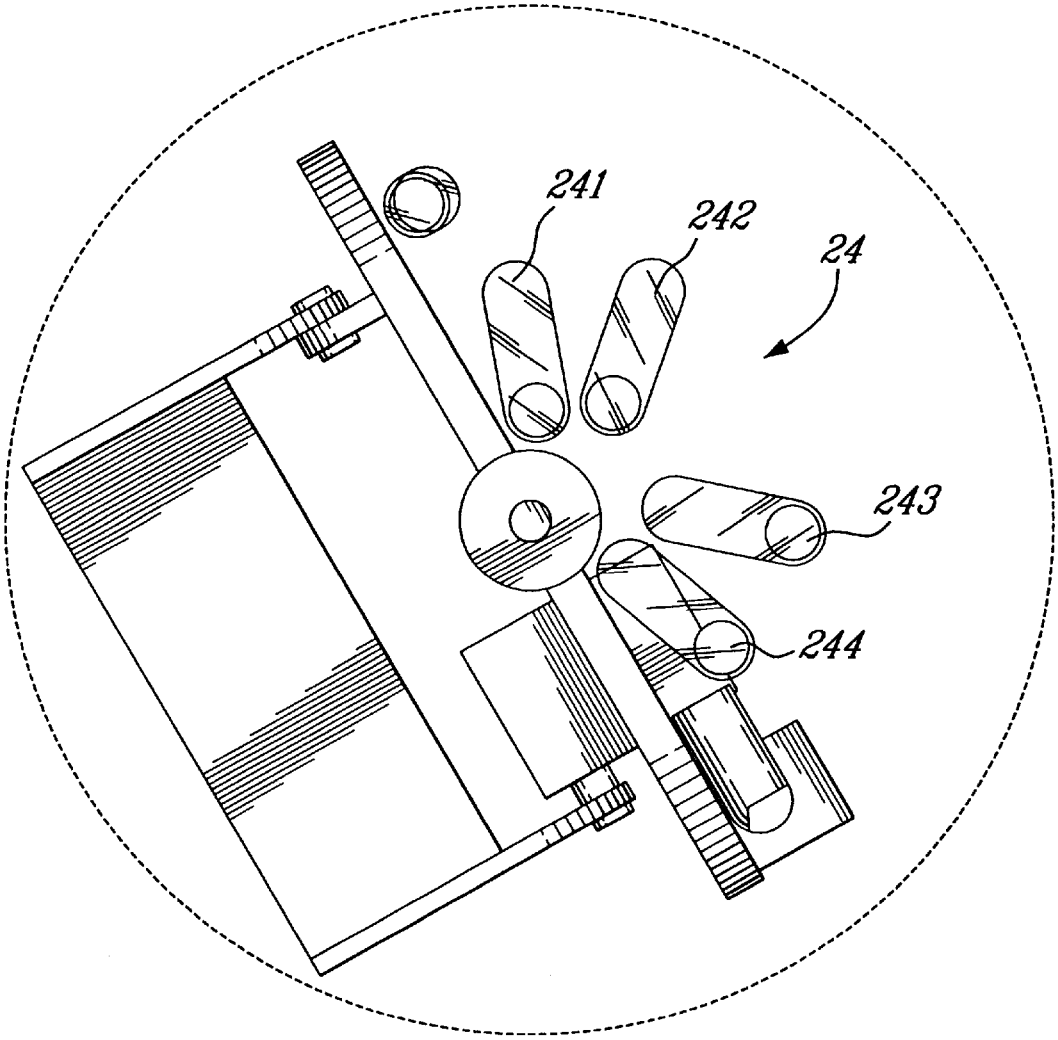
FIG. 6 is another side, elevational view of the drive and steering systems of the robot ball of FIG. 1.

Referring to FIG. 4, the first inclinometer 24 detects tilt of the platform 6 about the axis of rotation 3. Inclinometer 24 is formed of four mercury switches 241, 242, 243 and 244 respectively positioned at angles of 15°, 75°, 105° and 165° with respect to the plane of the platform 6. This arrangement of four mercury switches 241–244 will enable detection of eight (8) angular positions of the platform 6 about the axis of rotation 3:

- horizontal (all the mercury switches 241–244 are closed as shown in FIG. 4);
- tilted upwardly (switches 241–243 closed and switch 244 open as shown in FIG. 5);
- face upward (switches 241–242 closed and switches 243–244 open as shown in FIG. 6)
- reversed upwardly (switch 241 closed and switches 242–244 open);
- reversed (all the mercury switches 241–244 open);
- reversed downwardly (switch 244 closed and switches 241–243 open);
- face downward (switches 243–244 closed and switches 241–242 open);
- tilted downwardly (switches 242–244 closed and switch 241 open).

Also, the mercury switches 241–244 will detect an impact between the robot ball 1 and an obstacle since, in such a case, the platform 6 and counterweight 9 will complete a turn about the axis 3.

Reading of the inclinometer 24 will enable the robot ball 1 to break intricate deadlocks unbreakable by conventional wheeled robots.

Figure 7:
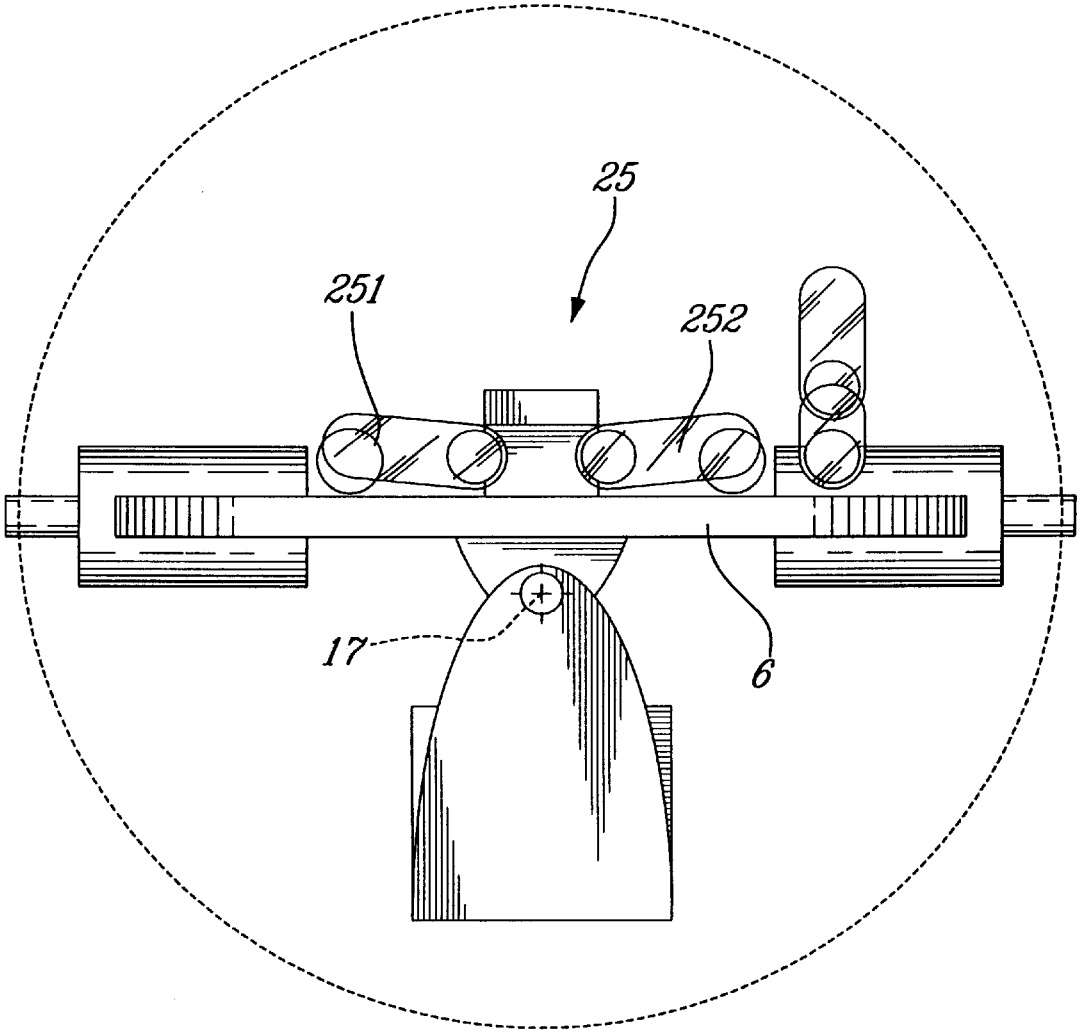
FIG. 7 is a rear, elevational view of the drive and steering systems of the robot ball of FIG. 1.
Figure 8:
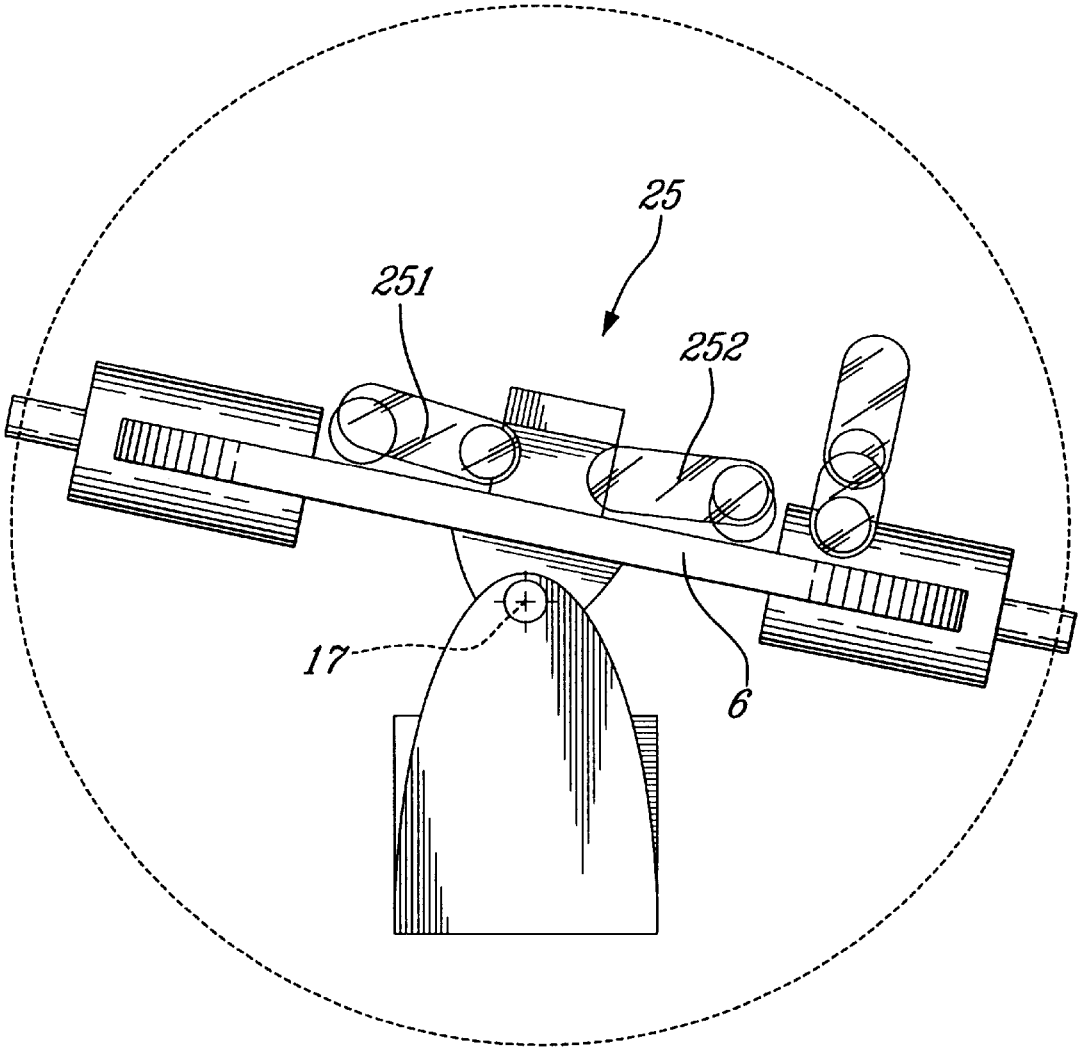
FIG. 8 is another rear, elevational view of the drive and steering systems of the robot ball of FIG. 1.

Referring to FIG. 7, the second inclinometer 25 detects tilt of the platform 6 about the pivot axis 17. Inclinometer 25 is formed of two (2) mercury switches 251 and 252 respectively slightly tilted toward each other. Mercury switches 251 and 252 will detect tilt of the platform 6 and shell 2 toward the left or the right, respectively. The arrangement of two (2) mercury switches 251–252 will enable detection of three (3) angular positions of the platform 6 about the pivot axis 17:

horizontal (the mercury switches 251 and 252 are closed as shown in FIG. 7);

tilted toward the left (switch 252 closed and switch 251 open); and tilted toward the right (switch 251 closed and switch 252 open as shown in FIG. 8).

The position and inclination of the mercury switch 251 and 252 will also enable detection of spinning of the robot ball 1 about a vertical axis; in this case the two (2) switches will be opened by the produced centrifugal force.

Of course, it is within the scope of the present invention to use other types of switches and/or inclinometers, as well as other types of tilt sensors.

Obstacle Detector

Figure 9:
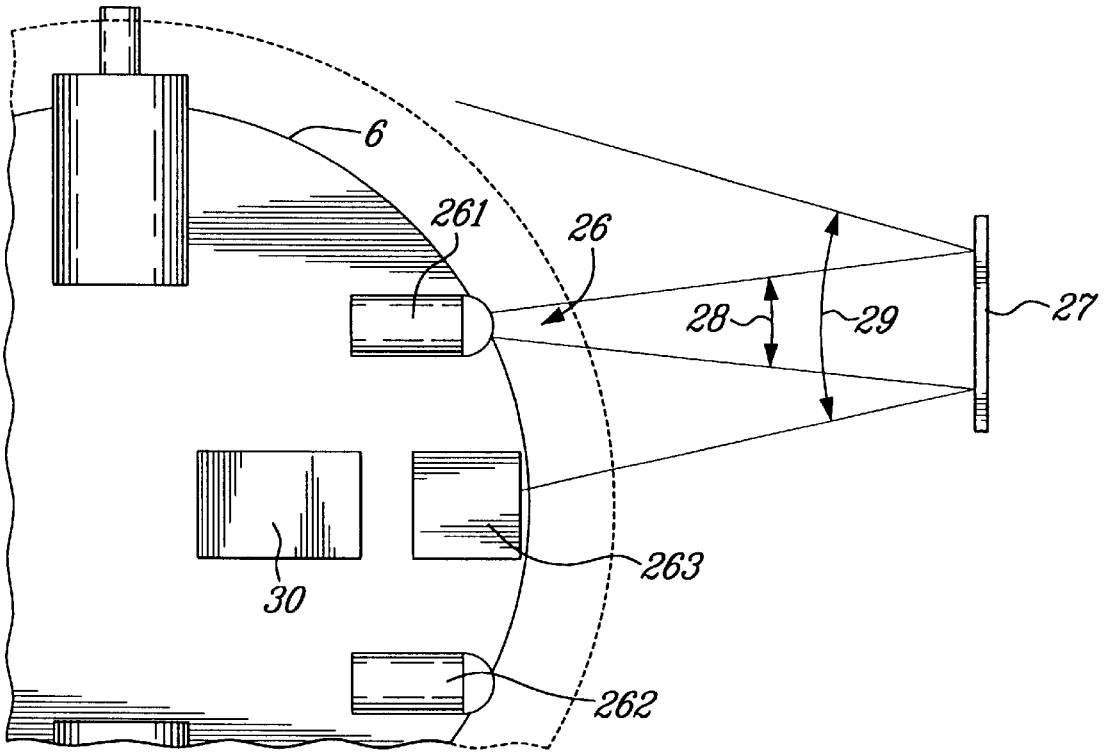
FIG. 9 is a top plan view of an obstacle detector of the robot ball of FIG. 1.

Referring to FIGS. 1 and 9, the top, front portion of the platform 6 is equipped with an obstacle detector 26 designed to detect obstacles such as 27 (FIG. 9).

The obstacle detector 26 comprises a pair of infrared light-emitting diodes 261 and 262 and an infrared detector 263 such as a phototransistor.

In operation, the diodes 261 and 262 will emit infrared light beams such as 28 (FIG. 9). Light beam such as 28 will reflect on an obstacle such as 27, and the reflected light beam such as 29 will reach the infrared detector 263 to thereby detect of the obstacle 27. Obviously, operation of the obstacle detector 26 requires adequate transparency of the shell 2 which, for example, can be made of transparent plastic material.

Of course, the use of other types of obstacle detector could be contemplated without departing from the spirit of the present invention.

Controller

As illustrated in FIG. 9, the robot ball 1 is further provided with an electronic controller 30. Of course, the controller 30 is supplied with electric energy from the battery 14.

Figure 10:
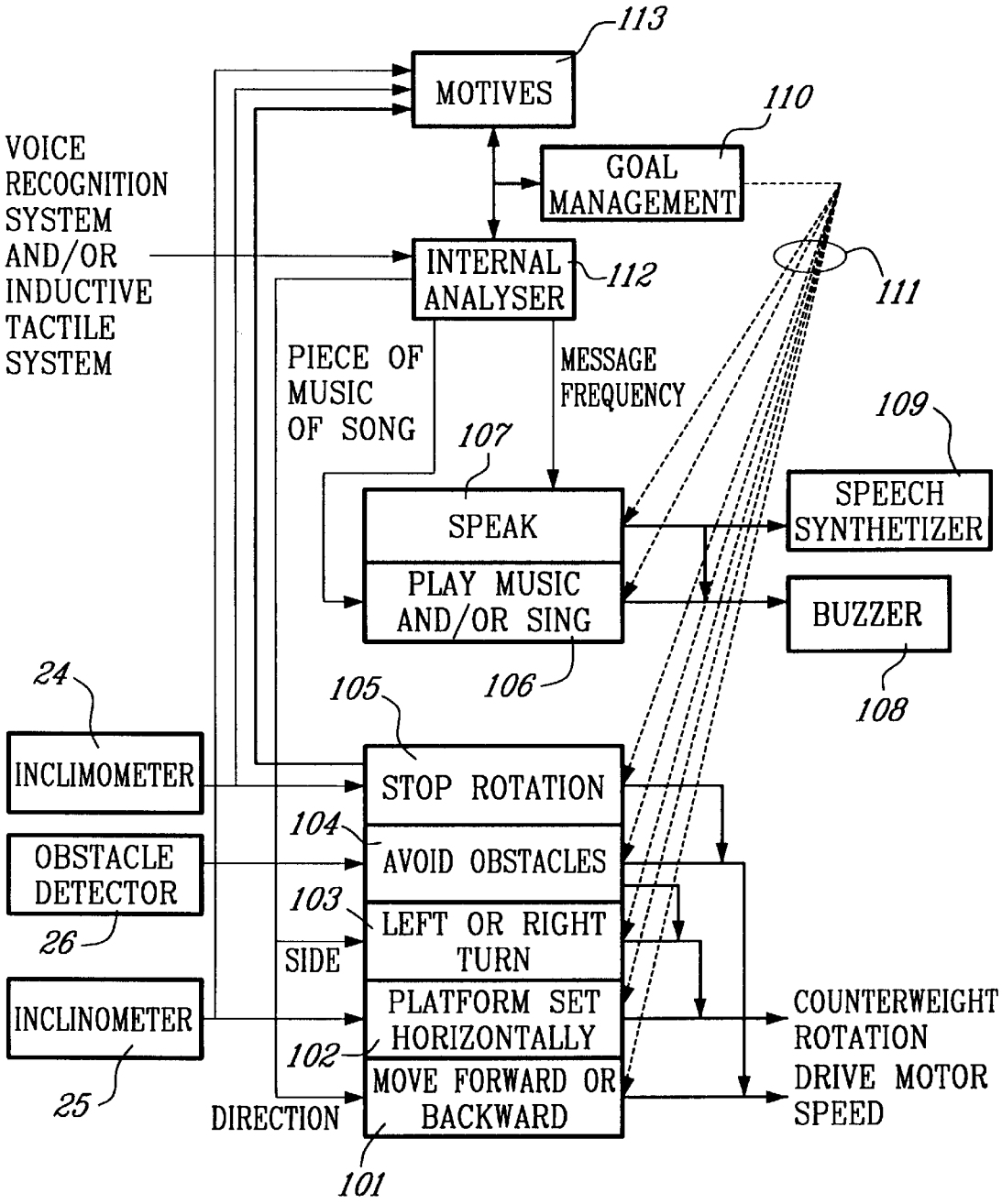
FIG. 10 is a schematic block diagram of an electronic controller of the robot ball of FIG. 1.

The architecture of the electronic controller 30 is illustrated, by way of a schematic block diagram, in FIG. 10. In the following example, an application of the robot ball 1 as a toy will be considered although many other applications of the robot ball 1 could be contemplated.

As illustrated in FIG. 10, the controller 30 comprises behaviour modules 101–105 responsive to the signals from the inclinometers 24 and 25 and the obstacle detector 26 to control the above defined driving system to:

move forward or backward the robot ball 1 (module 101), while controlling the speed of rotation of the drive motors 7 and 8 in response to signals from the inclinometer 24 to keep the platform 6 as horizontal as possible;

direct the robot ball 1 along a straight line by keeping the platform 6 as horizontal as possible through the servomotor 20 and with the help of the inclinometer 25 (module 102);

turn left or right by tilting the platform 6 about pivot axis 17 in either direction through the servomotor 20 and in relation to the signal from the inclinometer 25 (module 103);

deactivate the drive motors 7 and 8 when the inclinometer 24 detects that the platform 6 is reversed in order to return this platform to its normal position (module 105);

avoid obstacles by turning, deactivating the drive motors 7 and 8, or reversing the direction of rotation of these drive motors 7 and 8 in response to an obstacle-indicative signal from the obstacle detector 26 (module 104);

etc.

The controller 30 further comprises a behaviour module 106 to enable the robot ball 1 to play music and/or sing and a behaviour module 107 to enable the robot ball 1 to speak.

The behaviour modules 101–107 are shown in FIG. 10 according to an order of priority. More specifically, the degree of priority of the various modules 101–107 increases from bottom to top in the control of:

the speed of rotation of the drive motors 7 and 8;

the rotation of the counterweight 9 about pivot axis 17;

a buzzer 108 for producing the music, songs and/or sound effects; and a speech synthesiser 109 for producing vocal messages;

taking into consideration whether the modules are activated and the associated detection conditions (inclinometers 24 and 25 and detector 26) are met.

Activation of the behaviour modules 101–107 is determined and controlled by the goal management module 110 through the links 111. Also, activation of the parameters of configuration of the behaviour modules 106 and 107 is determined and controlled by an internal analyser module 112. Activation of the behaviour modules 101–107 as well as the parameters of configuration of the behaviour modules 106 and 107 is carried out on the basis of internal variables called "motives" (see module 113). These motives are variables having a level of excitation varying between 0% and 100% and a level of activation of 0 or 1. The level of activation is determined by the level of excitation, and indicates whether the behaviour modules are activated or not. The level of excitation examines different factors such as sensors 24–26, behaviour use and influence of the other motives, and add their respective influences in time.

For example, in the case of an application of the robot ball as a toy and when the robot ball frequently hits obstacles, the incentives can be AWAKENING, NEED BATTERY RECHARGE, and DISTRESS.

In the case of DISTRESS, goal management module 110 and the internal analyser module 112 controls the behaviour module 107 to generate a distress vocal message reproduced through the speech synthesiser 109. The goal management module 110 also controls the behaviour modules 101–105 for example to modify the direction of rotation of the drive motors 7 and 8 and the angular position of the counterweight 9 about axis 17 in an attempt to break the deadlock. If the deadlock has not been broken after a certain period of time, all the behaviour modules are inhibited during a given period of time to allow the robot ball to stabilise before it attempts again to break the deadlock.

In the case of NEED BATTERY RECHARGE, goal management module 110 and the internal analyser module 112 controls the behaviour module 107 to generate a vocal message reproduced through the speech synthesiser 109 that the robot ball 1 needs battery recharge. The goal management module 110 also inhibits all the other behaviour modules 101–105.

In the case of AWAKENING, goal management module 110 and the internal analyser module 112 controls the behaviour modules 101–107 for normal operation of the robot ball 1 as described hereinafter.

Obviously, it is within the scope of the present invention to use another architecture of controller capable of fulfilling the same, similar or other functions.

States of the Robot Ball

Figure 11:
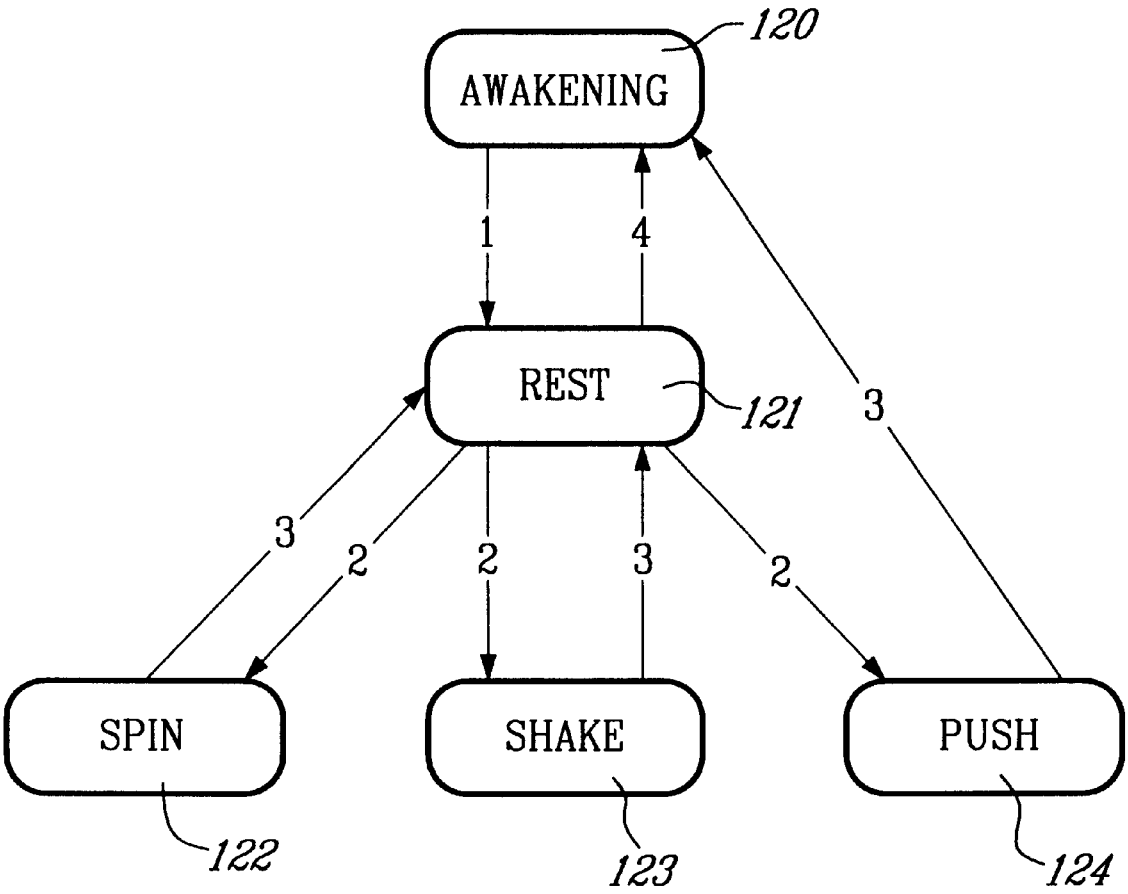
FIG. 11 is a schematic block diagram showing different states of the robot ball.

States of the robot ball 1 are shown, for the purpose of exemplification only, in FIG. 11.

During AWAKENING (state 120), the goal management module 110 controls the behaviour modules 101–107 to periodically stop movement of the robot ball 1. The goal management module 110 then asks for a period of rest (state 121) of the robot ball 1 through the internal analyser module 112, the behaviour module 107 and the speech synthesiser 109.

During the periods of rest of the robot ball 1, the goal management module 110 asks the child to spin it (state 122), to shake it (state 123), or to push it (state 124) through the internal analyser module 112, the behaviour module 107 and the speech synthesiser 109. The goal management module 110 periodically repeats this request.

If the sensors 24–26 indicate that the child did comply with the request, the goal management module 110 thanks the child through the internal analyser module 112, the behaviour module 107 and the speech synthesiser 109.

If the sensors 24–26 indicate that the child did not correctly respond to the request, the goal management module 110 asks the child to stop through the internal analyser module 112, the behaviour module 107 and the speech synthesiser 109.

If the child does no comply with the request, the goal management module 110 then indicates through the internal analyser module 112, the behaviour module 107 and the speech synthesiser 109, that the robot ball 1 is bored.

In the case of a request to spin the robot-ball, the goal management module 110 generates messages related to the rotation of the robot ball through the internal analyser module 112, the behaviour module 107 and the speech synthesiser 109:

- when spinning detected through the centrifugal force applied to the mercury switches 251 and 252 of the inclinometer 25 is fast, the goal management module 110 indicates that the robot ball 1 is dizzy;
- otherwise, the goal management module 110 asks the child to spin the robot ball 1 again.

A given period of time after the robot ball 1 has been spun or shaken, the goal management module 110 reactivates the behaviour modules 101–107 and the robot ball 1 moves again until the AWAKENING cycle is completed. After the robot ball 1 has been pushed, the goal management module 110 reactivates the behaviour modules 101–107 and the robot ball 1 moves again until the AWAKENING cycle is completed. The goal management module 110 then deactivates the behaviour modules to inactivate the robot ball 1 during a certain period of time before it returns to the AWAKENING mode.

The periods of occurrence of the states of the robot ball 1 are determined by means of fixed increments or randomly generated levels so as to create no automatism.

Other messages can be generated by the goal management module 110 through the internal analyser module 112, the behaviour module 107 and the speech synthesiser 109 in response to particular events detected by the modules 25–26. Examples of such messages are given below:

| Message | Event |
|---|---|
| Oups! | The platform 6 has reversed |
| Help! | The platform 6 often reverses |

-continued

| Message | Event |
|---|---|
| Weeeeee! | The robot ball is spun, upon request |
| Thank you | The robot ball 1 has been recharged or the child has complied with one request |
| Stop, please | The robot ball 1 is displaced during a rest period |
| I'm bored | The child does not comply with the requests of the robot ball 1 |
| Push me gently, please | During a rest period, the robot ball 1 asks the child to push it to move again |
| Spin me, please | During a rest period, the robot ball 1 asks the child to spin it |
| Shake me gently, please | During a rest period, the robot ball asks the child to shake it gently |
| I feel dizzy | The child spun the robot ball |
| Charge me, please | The robot ball needs to be charged |
| See you | The AWAKENING cycle is over |
| Hello, how are you | The AWAKENING cycle begins |
| (Name of the child) | Name of the child used in certain messages in order to personalize these messages |

Obviously, a system for recording the name of the child must be implemented if the last feature of the above table is to be used.

It is also within the scope of the present invention to implement a voice recognition system (block 125 of FIG. 10) to enable the robot ball 1 to respond to vocal instructions. It is further within the scope of the present invention to implement an inductive tactile system (block 125 of FIG. 10) to enable the robot ball 1 to respond to tactile stimuli.

Just a word to mention that it would be possible to implement a system enabling parents to modify or add certain messages to personalize the robot ball 1 by:

- as mentioned earlier in the description, recording the name of the child;
- store vocal messages that the robot ball 1 will periodically repeat to the child at various frequencies;
- enabling the robot ball to recognize only vocal commands from a particular child;
- etc.

These features are interesting since they will enable the use of the robot for educative and even therapeutic purposes, for example to help an autistic child to open himself to the exterior world.

Although an application of the robot ball 1 as a toy has been described as preferred embodiment in the foregoing description, it is also intended to develop other versions of the robot ball 1 using the same concept but adapted to other applications such as exploration, on-site measurements, inspection of conduits, landmine detection, over water, etc.

The robot ball 1 presents, amongst others, the following advantages:

- different trajectories of movement can be implemented in relation to the program of the controller and detection through various sensors such as 24–26;
- a robot ball 1 encapsulated into a shell 2 is capable of displacing naturally in its environment with lower risks to fall into a deadlock;
- the shell 2 is impervious and protect the robot ball from dust and debris;
- in the application as a toy, the shell 2 protects the robot ball from shocks and improper use by the children;
- the shape of the shell 2 corresponds to the shape of a ball;
- the trajectories of the robot ball 1 generated by the controller can be easily reconfigured through simple programming;

interactive use of the robot ball 1 is possible through vocal messages;

implementation of an inductive tactile system is possible; etc.

Although the present invention has been described hereinabove by way of a preferred embodiment thereof, this embodiment can be modified at will, within the scope of the appended claims, without departing from the spirit and nature of the subject invention.

What is claimed is:

1. A robot ball comprising:

an encapsulating shell having an axis of rotation and an outer annular tread surface centered on the axis of rotation; and a drive system encapsulated in the shell and comprising:

a first motorized mechanism having a stator portion and a rotor portion centered on the axis of rotation and connected to the shell;

a counterweight connected to the stator portion and spaced apart from the axis of rotation whereby, due to inertia of the counterweight, rotation of said rotor portion rotates the shell to roll the tread surface on the ground; and a steering system comprising:

a second motorized, counterweight displacing mechanism through which the counterweight is connected to the stator portion, the second motorized mechanism defining a course of displacement of the counterweight which extends along the axis of rotation whereby, in operation, activation of the second motorized mechanism displaces the counterweight along the axis of rotation, tilts said axis of rotation, displaces the center of gravity of the robot ball, and thereby changes the trajectory of the robot ball.

2. A robot ball as recited in claim 1, wherein the second motorized mechanism includes a pivot assembly having a pivot axis transversal to the axis of rotation whereby, in operation, activation of the second motorized mechanism rotates the counterweight about the pivot axis, tilts the axis of rotation, displaces the center of gravity of the robot ball, and thereby changes the trajectory of the robot ball.

3. A robot ball as recited in claim 1, wherein the encapsulating shell comprises a generally spherical outer face.

4. A robot ball as recited in claim 1, wherein the annular tread surface is generally elliptical in a cross sectional plane in which the axis of rotation is lying.

5. A robot ball as recited in claim 2, wherein the pivot axis is substantially perpendicular to the axis of rotation.

6. A robot ball as recited in claim 1, wherein the stator portion comprises a platform.

7. A robot ball as recited in claim 6, wherein:

the first motorized mechanism comprises at least one electric drive motor having a stator and a rotor;

the stator of the electric motor is secured to the platform;

the rotor of the electric motor is centered on the axis of rotation and is connected to the shell.

8. A robot ball as recited in claim 6, wherein:

the first motorized mechanism comprises first and second electric drive motors each having a stator and a rotor;

the stator of the first electric drive motor is secured to the platform;

the stator of the second electric drive motor is secured to the platform;

the rotor of the first electric drive motor is centered on the axis of rotation and is connected a first point of the shell; and the rotor of the second electric drive motor is centered on the axis of rotation and is connected to a second point of the shell diametrically opposite to the first point of said shell.

9. A robot ball as recited in claim 2, wherein:

the stator portion comprises a platform having an underside;

the second motorized mechanism comprises an electric servomotor having a stator and a rotor;

the stator of the electric servomotor is secured to the underside of the platform; and the rotor of the electric servomotor is centered on the pivot axis and is connected to the counterweight.

10. A robot ball as recited in claim 1, wherein the counterweight comprises an electric battery.

11. A robot ball as recited in claim 9, wherein the counterweight comprises an electric battery and a bracket mechanically connecting the battery to the rotor of the servomotor.

12. A robot ball as recited in claim 7, further comprising an inclinometer so mounted on the platform as to measure an inclination of said platform about the axis of rotation, and a controller of the speed of rotation of said at least one electric drive motor in relation to the measured platform inclination.

13. A robot ball as recited in claim 8, further comprising an inclinometer so mounted on the platform as to measure an inclination of said platform about the pivot axis, and a controller of the electric servomotor in relation to the measured platform inclination about the pivot axis.

14. A robot ball as recited in claim 1, further comprising at least one condition sensor and a robot ball controller responsive to said at least one sensor, wherein said robot ball controller comprises a drive and steering systems controller portion.

15. A robot ball as recited in claim 14, wherein said at least one condition sensor comprises a robot ball spin sensor unit detecting spinning of the robot ball.

16. A robot ball as recited in claim 14, further comprising a voice message generating system controlled by the robot ball controller.

17. A robot ball as recited in claim 14, wherein said at least one condition sensor comprises a voice instructions recognizing system.

18. A robot ball as recited in claim 14, wherein said at least one condition sensor comprises a tactile system.

19. A robot ball as recited in claim 1, further comprising an obstacle detector and a controller of said second motorized mechanism in response to an obstacle detected by said obstacle detector.

20. A robot ball as recited in claim 19, wherein the obstacle detector is an infrared obstacle detector comprising at least one infrared beam generator and an infrared beam detector detecting infrared light generated by the infrared beam generator after reflection of said infrared light by an obstacle.

21. A robot ball as recited in claim 1, further comprising a controller of the drive and steering systems, said controller comprising a generator of various trajectories of the robot ball.

22. A robot ball comprising:

an encapsulating shell having an axis of rotation and an outer annular tread surface centered on the axis of rotation; and a drive system encapsulated in the shell and comprising:

a motorized mechanism having a stator portion and a rotor portion centered on the axis of rotation and connected to the shell;

a counterweight connected to the stator portion and spaced apart from the axis of rotation whereby, due to inertia of the counterweight, rotation of said rotor portion rotates the shell to roll the tread surface on the ground;

an inclinometer so mounted on the stator portion as to measure an inclination of said stator portion about the axis of rotation; and a controller of the speed of rotation of said rotor portion in relation to the measured inclination.

23. A robot ball as recited in claim 22, wherein:

the stator portion comprises a platform;

said inclinometer is mounted on said platform;

the motorized mechanism comprises at least one electric drive motor having a stator and a rotor;

the stator of the electric drive motor is secured to the platform;

the rotor of the electric drive motor is centered on the axis of rotation and is connected the shell;

the inclinometer is mounted on the platform to measure an inclination of said platform about the axis of rotation; and said controller is a controller of the speed of rotation of the electric drive motor in relation to the measured platform inclination.

* * * * *